United States Patent [19]

Giusti

[11] Patent Number: 4,525,072

[45] Date of Patent: Jun. 25, 1985

[54] ROTARY MIXING APPARATUS

[75] Inventor: Raolo B. Giusti, London, England

[73] Assignee: T. Giusti & Son Ltd., England

[21] Appl. No.: 496,058

[22] Filed: May 19, 1983

[51] Int. Cl.[3] ..... B01F 7/02

[52] U.S. Cl. ..... 366/168; 366/174; 366/292; 366/313; 99/348

[58] Field of Search ..... 99/348; 366/167, 168, 366/171, 174, 265, 292, 295, 312, 313, 314, 249, 250, 251, 299

[56] References Cited

U.S. PATENT DOCUMENTS

| | | | |
|---|---|---|---|
| 1,764,498 | 6/1930 | Beers | 366/265 X |
| 1,991,148 | 2/1935 | Gephart | 366/167 X |
| 3,045,985 | 7/1962 | LaRock, Sr. | 366/167 X |
| 3,739,710 | 6/1973 | Costa et al. | 99/348 |
| 3,773,302 | 11/1973 | Johnson et al. | 366/168 X |
| 3,964,733 | 6/1976 | Tutzschky et al. | 366/314 X |
| 4,123,801 | 10/1978 | Armanet | 366/292 |
| 4,198,376 | 4/1980 | Fournel et al. | 366/295 X |
| 4,300,446 | 11/1981 | Hazen | 366/174 X |

FOREIGN PATENT DOCUMENTS

| | | | |
|---|---|---|---|
| 59854 | 5/1942 | Denmark | 366/249 |
| 2259094 | 7/1973 | Fed. Rep. of Germany | 366/249 |
| 1196567 | 5/1959 | France | 366/265 |
| 278574 | 2/1952 | Switzerland | 366/314 |
| 302152 | 4/1929 | United Kingdom | 366/314 |
| 627384 | 8/1949 | United Kingdom | 99/348 |

*Primary Examiner*—Philip R. Coe

*Attorney, Agent, or Firm*—Cantor and Lessler

[57] ABSTRACT

A rotary mixing apparatus is described. The apparatus comprises a vessel (1) for containing the material to be processed, an outlet (9) for the processed material in a lower portion (2) of the vessel and an agitator connectable through the lower portion of the vessel to drive means (10) outside the vessel so as to be rotatable in the vessel about an axis inclined to the vertical, the agitator being operable to lift material to be mixed from the lower portion (2) to an upper portion (3) of the vessel (1).

9 Claims, 1 Drawing Figure

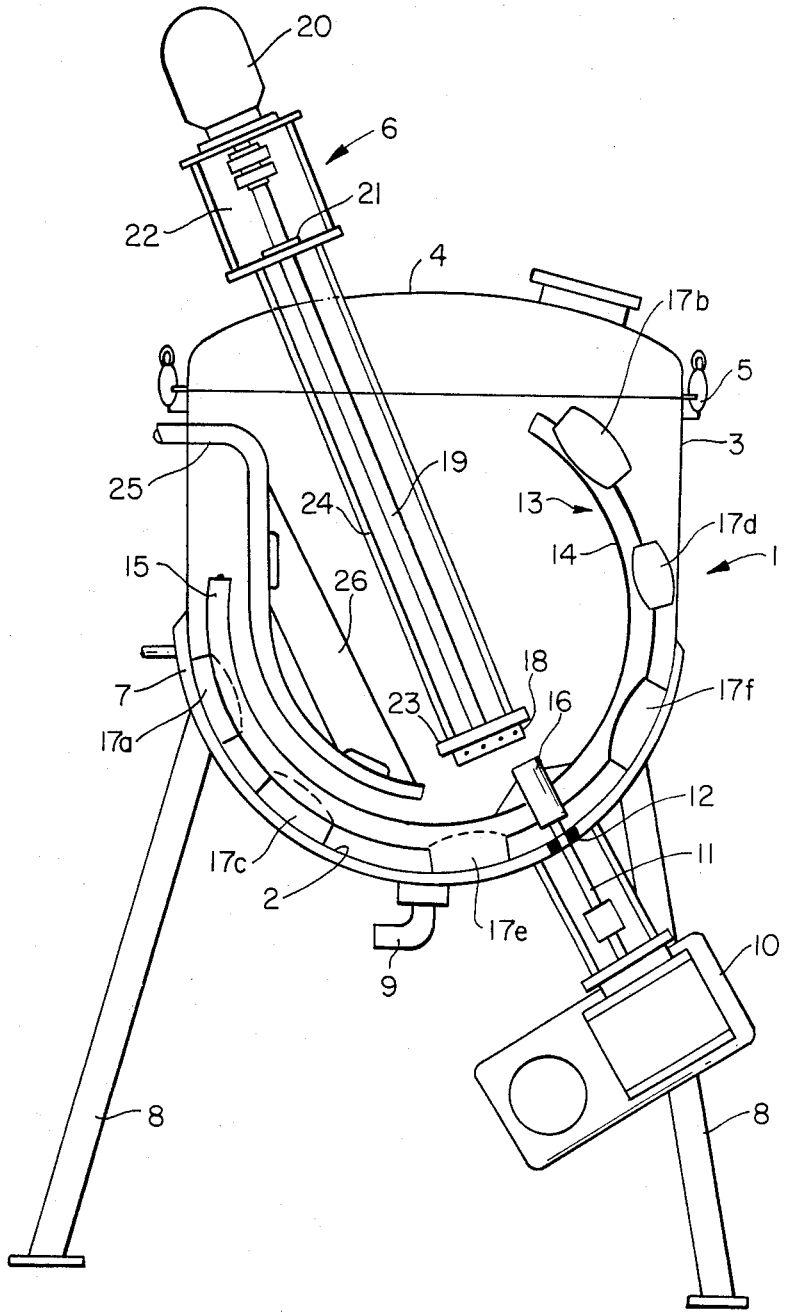
20
6
21
22
4
17b
5
3
25
19
24
13
17d
14
1
15
26
18
7
23
16
17f
17a
12
17c
11
2
17e
10
9
8
8

ROTARY MIXING APPARATUS

This invention relates to a rotary mixing apparatus for use for example, in the processing of materials in the food, pharmaceutical and cosmetic industries.

In these industries, it is necessary to mix together various liquids and solids and this is normally carried out in a mixing vessel provided with a rotating agitator. Mixers are known with agitators rotatable about a vertical axis but, unless these are operated at very high speeds, the materials to be mixed tend to settle out in a "dead spot" in the base region thereof. Attempts to overcome this problem by rotating the agitator about a horizontal axis have been made, whereby the agitator repeatedly lifts the material at the bottom of the mixing vessel and raises it to the top. Whilst this was found to be quite successful in resolving the mixing difficulties, it created other problems because the agitator had to be mounted on a horizontal shaft rotatable in fixed bearings at either side of the mixing vessel which meant that the agitator could not be removed for cleaning.

It is desirable to provide the mixer with an emulsifier and in the prior art this has been mounted in the base of the mixing vessel. As the agitator has arms on which scrapers are mounted to contact the vessel wall on rotation of the agitator to scrape off any build up of glutinous or other material thereon which can affect heat transfer in the vessel (the vessel is usually surrounded with a heat transfer jacket for heating or cooling purposes) the arms have had to be arranged so that they do not foul the emulsifier head. This meant that a substantial portion of the bottom of the vessel could not be scraped clean.

It is an object of the invention therefore to provide a rotary mixing apparatus which overcomes or substantially reduces the above problems.

Accordingly, in one aspect of the present invention, there is provided a rotary mixing apparatus comprising a vessel for containing the material to be processed and an agitator rotatable in the vessel about an axis inclined to the vertical and about a point located in the lower region of the vessel, the agitator being operable to lift material to be mixed from the lower portion to an upper portion of the vessel.

According to a second aspect of the present invention, there is provided a rotary mixing apparatus comprising a vessel for containing the material to be processed and an agitator connectable to drive means through a lower portion of the vessel so as to be rotatable in the vessel about an axis inclined to the vertical and intersecting the lower portion of the vessel, the agitator being operable to lift material to be mixed from the lower portion to an upper portion of the vessel.

Preferably, the said inclined axis extends through the agitator so that the agitator has a first arm disposed on one side of the axis and a second arm disposed on the other side of the axis.

Conveniently the agitator is C-shaped. Preferably the lower portion of the vessel is hemi-spherical, the agitator being part-circular with the two arms thereof coplanar.

Desirably, the agitator is provided with scraper means which may be scraper blades provided along the length of the agitator arms and positioned to scrape the lower portion of the vessel over substantially the whole area thereof. In a preferred embodiment, several individual scraper blades are provided along the length of each agitator arm; but a single scraper blade may be used if desired.

Conveniently an outlet for processed material is located centrally in the lower portion of the mixing vessel although, of course, the outlet could be located elsewhere in the lower portion of the vessel.

In a preferred embodiment an inlet for additives enters the vessel at one side adjacent the upper portion thereof and extends down into the vessel. This arrangement enables the additives to be integrated into the processed material at the point of maximum agitation which is especially important when the additive is perfume. Conveniently the inlet is a generally S-shaped pipe which may also have mounted thereon a baffle plate.

Preferably the agitator is releasably mounted on the drive therefor to permit its easy removal for cleaning purposes.

Desirably, the mixer also includes an emulsifier mounted at the upper porton of the vessel with a discharge head at the end of a drive shaft extending from the upper portion of the vessel toward the lower portion thereof, the discharge head in use being located adjacent the point of rotation of the agitator. Conveniently bars are also provided on the emulsifier alongside the drive shaft.

The drawing shows a side, sectional view of the mixing container.

A preferred embodiment of a rotary mixing apparatus of the invention will now be described, by way of example only, with reference to the single FIGURE of the accompanying drawing, which shows a mixing container or vessel 1 having a hemi-spherical lower portion 2 and a cylindrical upper portion 3. A domed lid 4 is hingedly connected to the container and clampable thereon by means of clamps 5 to form a vacuum tight seal therewith.

The lower portion of the container 1 is provided with a jacket 7 through which a heating or cooling medium may be circulated to heat or cool the material in the container during mixing. The container is supported on spaced legs 8, only two of which are visible in the drawing. An outlet for processed material is preferably centrally located in the lower portion of the container 1, the outlet including a control valve (not shown).

A motor 10 is mounted externally beneath the lower portion of the container 1 and has a drive shaft 11 which is offset with respect to the central outlet 9. The axis of rotation of the shaft 11 is also inclined to vertical as can be seen from the drawing. The free end of the shaft 11 enters the container through a sealed bearing 12 and an agitator 13 is fitted onto the free end of the shaft.

As can be seen from the drawing, the agitator 13 is part-circular and includes two spaced co-planar arms 14, 15 which are connected to a mounting hub 16 preferably provided with a bayonet fitting to enable it to be releasably secured to the end of the drive shaft 11.

Scrapers 17 are spaced along the length of the agitator arms 14, 15 to which they are attached by bolts (not shown) which allow an adjustable pivotable movement thereof. The outer edge of each scraper is curved to conform to the spherical portion of the vessel.

It will be seen from the drawing that the lower portion of the vessel is scraped in annular bands, the top band being scraped by scraper 17*a* on arm 15, the next band down by scraper 17*b* on arm 14, the next band down by scraper 17*c* on arm 15, the next band down by scraper 17*d* on arm 14 and so on. It will be noted that the outlet is also scraped partly by scraper 17*e* and partly by scraper 17*f*, thus assisting in the discharge of processed material.

An emulsifier 6 extends downwardly from lid 4 so that its rotating head is adjacent hub 16 of the agitator. The head 18 is rotated by a shaft 19 driven by motor 20 mounted on the hinged lid 4. The shaft 19 is mounted in a bearing 21 in the lid and is lubricated from a surrounding chamber 22 around it which is normally filled with a lubricant such as water or oil.

The rotating head is mounted in bearings (not shown) in a plate 23, this plate also serving as a mounting for bars 24 extending between the plate and the lid 4.

An S-shaped inlet pipe 25 for additives extends from the side of the container 1 at a location above the agitator down to the bottom thereof, its outlet being located centrally of the container. A baffle plate 26 is also mounted on the inlet pipe 25.

The illustrated processor operates on the basis that the material to be mixed is carried up the container 1 by means of the arms 14, 15 and to an extent by the scrapers 17, and then allowed to fall back under gravity into the container as the arms conclude their upward path. Mixing within the swept area of the arms is assisted by the bars 24, the baffle plate 26 and the inlet pipe 25 as well as the drive shaft 19 for the emulsifier head.

The illustrated embodiment has several advantages over the prior art arrangements. Firstly by doing away with the usual bottom mounted emulsifier of the prior art, the whole of the vessel lower portion can be acted on by the thermal jacket and, furthermore, there are no unscraped annular bands therein. Secondly, the outlet 9 can be centrally located in the lower portion of the container, because the drive for the agitator is located to one side so the risk of pools of mixed material being left around the outlet on emptying the container is reduced. The problems these pools cause is that they can contaminate the next batch of material to be mixed. Thirdly, almost the whole of the lower portion of the container is swept by the scrapers, the only area not covered being that immediately adjacent the shaft on which the agitator is mounted. This is an important advantage because unless effective scraping takes place, the build up of material on the container walls can quickly completely negate a heat transfer from the thermal jacket 7, particularly if the jacket is being used for cooling purposes. Fourthly, by using a bottom drive for the agitator which is offset with respect to the vertical axis, improved mixing at low speeds can be achieved compared with a bottom driven mixer with vertically contrarotating blades as the material to be mixed is continually lifted from the bottom of the container to the top. Moreover, the fact that the agitator is driven from below the mixing vessel and is releasably mounted on the drive shaft which protrudes through the vessel bottom, allows access to be gained easily from above the vessel so that the agitator may be removed for cleaning.

Whilst it is preferred that the processor be provided with the illustrated overhead emulsifier, this is not essential. Nor is the hinged lid 4. This is only needed if the mixer is to operate under a vacuum. The mixer would however work equally well at atmospheric pressure with an open top.

Another important advantage of the illustrated mixer over a conventional one with blades rotated about a centrally located vertical axis is that it has no mixing "dead spot" where little or no agitation takes place because the mixture is continually dropped into the central area between the agitator arms and into contact with the emulsifier and the additive inlet pipe. In addition, because the axis of rotation of the agitator is to one side of the bottom of the base of the container any unagitated material in this area will tend to fall towards the container bottom and thereafter be picked up again by the agitator

I claim:

1. A rotary mixing apparatus comprising a vessel for containing the material to be processed, at least the lower portion of the vessel being hemi-spherical and having a vertical axis; a generally C-shaped part circular agitator rotatable in the vessel about an axis inclined to the vertical and about a point located in the lower region of the vessel but offset from said vertical axis, said inclined axis extending through the agitator so that the agitator has a first arm disposed on one side of the axis and a second arm disposed on the other side of the axis, said two arms being co-planar, said agitator being provided with scraper means for scraping the lower portion of the vessel and being operable to lift material to be mixed from the lower portion to an upper portion of the vessel; external drive means for said agitator located at the lower portion of said vessel; a lid hingedly disposed on the top of said vessel; and an emulsifier mounted on said lid, passing therethrough at an angle inclined to the vertical, said emulsifier having a discharge head at the end of a drive shaft extending at said angle inclined to the vertical from the upper portion of the vessel towards the lower portion thereof, the discharge head, in use, being located adjacent the point of rotation of said agitator, whereby said lid can be hingedly opened.

2. An apparatus according to claim 1, wherein the scraper means comprises one or more scraper blades.

3. An apparatus according to claim 1, wherein the scraper means is in the form of a plurality of scraper blades provided along the length of the agitator arms and positioned to scrape substantially the whole area of the lower portion of the vessel.

4. An apparatus according to claim 1, wherein an outlet for proposed material is located centrally in the lower portion of the vessel.

5. An apparatus according to claim 1, wherein an inlet for additives enters the vessel at one side adjacent the upper portion thereof and extends down into the vessel.

6. An apparatus according to claim 5, wherein the additives inlet is a generally S-shaped pipe.

7. An apparatus according to claim 6, wherein a baffle plate is mounted on the S-shaped pipe.

8. An apparatus according to claim 1, wherein bars are provided on the emulsifier alongside the drive shaft.

9. An apparatus according to claim 1, wherein said drive means comprises a motor operatively connected to a drive shaft which passes through the vessel by means of a sealed bearing, said agitator is mounted on a hub means, and said hub means is releasably mounted on said drive shaft by means of a bayonet fitting.

* * * * *